United States Patent [19]

Andorsen

[11] Patent Number: 4,926,775

[45] Date of Patent: May 22, 1990

[54] DEVICE FOR CLEANING SURFACES, PARTICULARLY IN WATER

[76] Inventor: John P. Andorsen, Dehlgaardstien 5, 7000 Trondheim, Norway

[21] Appl. No.: 181,733

[22] Filed: Apr. 14, 1988

[51] Int. Cl.[5] ..... B63B 59/00

[52] U.S. Cl. ..... 114/222; 15/1

[58] Field of Search ..... 114/222; 440/38–40; 15/1, 7; 134/167 R, 167 C

[56] References Cited

U.S. PATENT DOCUMENTS 3,170,180 2/1965 Winston et al. ..... 134/167 R 4,348,192 9/1982 Pansini ..... 440/38

*Primary Examiner*—Joseph F. Peters, Jr.

*Assistant Examiner*—Jesus D. Sotelo

*Attorney, Agent, or Firm*—James E. Pittenger

[57] ABSTRACT

A cleaning apparatus for use under water, particularly for cleaning vertical surfaces which are fouled by marine organisms. One or more nozzles (19*a–c*) for spraying water at high pressure at a surface to be cleaned are arranged on a rotary disc-shaped unit (14)where the rotation axis is intended to be generally perpendicular to the surface which is to be cleaned. The nozzles are obliquely located in a circular plane so that the rotating unit (14) can rotate. Beyond the periphery of the rotating unit (14) there is a casing (12) which forms an annular chamber (13) with an outlet which is at least partly directed away from the surface which is to be cleaned. The annular chamber (13) is formed from two generally cylindrical or truncated conical casing units (20, 30) which are positioned at a radial distance from each other with their internal ends concentric with respect to the nozzle holder (11).

9 Claims, 4 Drawing Sheets

DEVICE FOR CLEANING SURFACES, PARTICULARLY IN WATER

BACKGROUND FOR THE INVENTION:

The invention relates to a cleaning apparatus for use under water, particularly for cleaning vertical surfaces and the underside of horizontal surfaces that have been fouled by marine organisms.

Cleaning equipment has been developed for cleaning the sides of ships and other marine floating constructions based on water jets, where a nozzle holder is attached to a carriage which is pulled along the surface by means of magnetism for example. This is dependent on the surface being constructed from ferro-magnetic materials, such as a steel-plated ship's side. Existing cleaning equipment is not however suitable for cleaning the kind of surfaces found in fish-farming plants. This is especially the case with non-continuous surfaces devoid of any particular mechanical strength, such as different types of nets.

THE PURPOSE OF THE INVENTION:

The main objective of the invention is to provide a cleaning apparatus which can be used with all conceivable floating structures which are exposed to marine fouling. The apparatus is simple to construct so that both its price and weight can be kept as low as possible. In addition, it is both efficient and reliable to use.

SUMMARY OF THE INVENTION:

It has been found that the water jets in this type of cleaning apparatus cause the nozzle holder to rotate. A stream of water which is expelled through an outlet in a chamber is in fact sufficient to hold the cleaning apparatus to the surface structure which is to be cleaned. These water jets will also produce an efficient means of cleaning the said surfaces. Further details of the design and use of the apparatus are provided in the example described below.

BRIEF DESCRIPTION OF THE DRAWINGS

A more detailed description of the invention will now be given in relation to the accompanying drawings, where.

DETAILED DESCRIPTION OF THE INVENTION

The cleaning apparatus in the figures consists of the following main elements: A rotating nozzle holder 11 within a casing 12 which forms an annular chamber 13 at the side of and behind the nozzle holder. The design and function of these units is described in more detail below.

Figure 3:
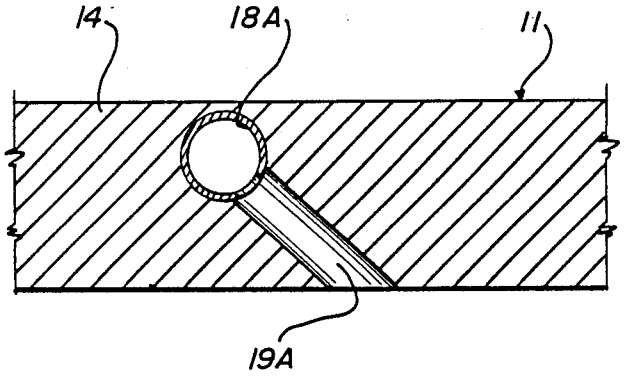
FIG. 3 shows a detail on the rotating disc in FIGS. 1 and 2, in a section along line 3—3 in FIG. 2.
Figure 4:
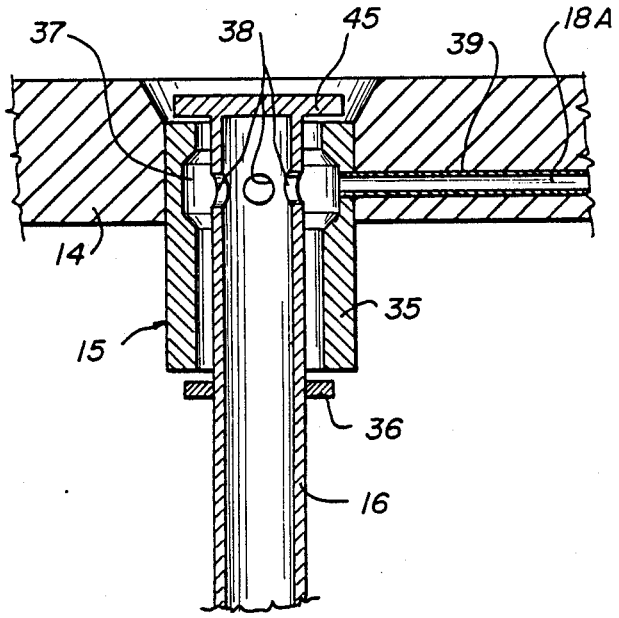
FIG. 4 shows an axial section through a bearing for the nozzle holder.

The nozzle holder 11 consists of a circular disc 14 which is connected to a bearing 15 as illustrated in FIG. 4. The bearing 15 consists of a supporting tube 16 which is permanently fixed to the casing 12 and has a high-pressure hose 17 attached. The rotating unit or disc 14 has three radial distribution outlet tubes or ducts 18*a–c* each extending at an angle of 120 degrees from the others, which are linked by the bearing 15 to the high-pressure hose 17. At the periphery of the disc, the distribution ducts 18*a–c* are led towards the outer exposed side of the disc or nozzle holder. The short outlet ducts 19*a–c* thus formed are directed at an oblique angle away from the nozzle holder's intended direction of rotation. FIG. 3 shows one means of design where the outlet ducts 19*a–c* are at an angle of 45 degrees from the plane of the nozzle holder.

The nozzle holder 11 can also be manufactured so that the rotating parts of the bearing 15, which will be described in more detail below, and three tubes which form the distribution ducts 18*a–c*, are cast in a circular plastic disc, possibly with reinforcement (not shown), to form the disc 14.

Figure 1:
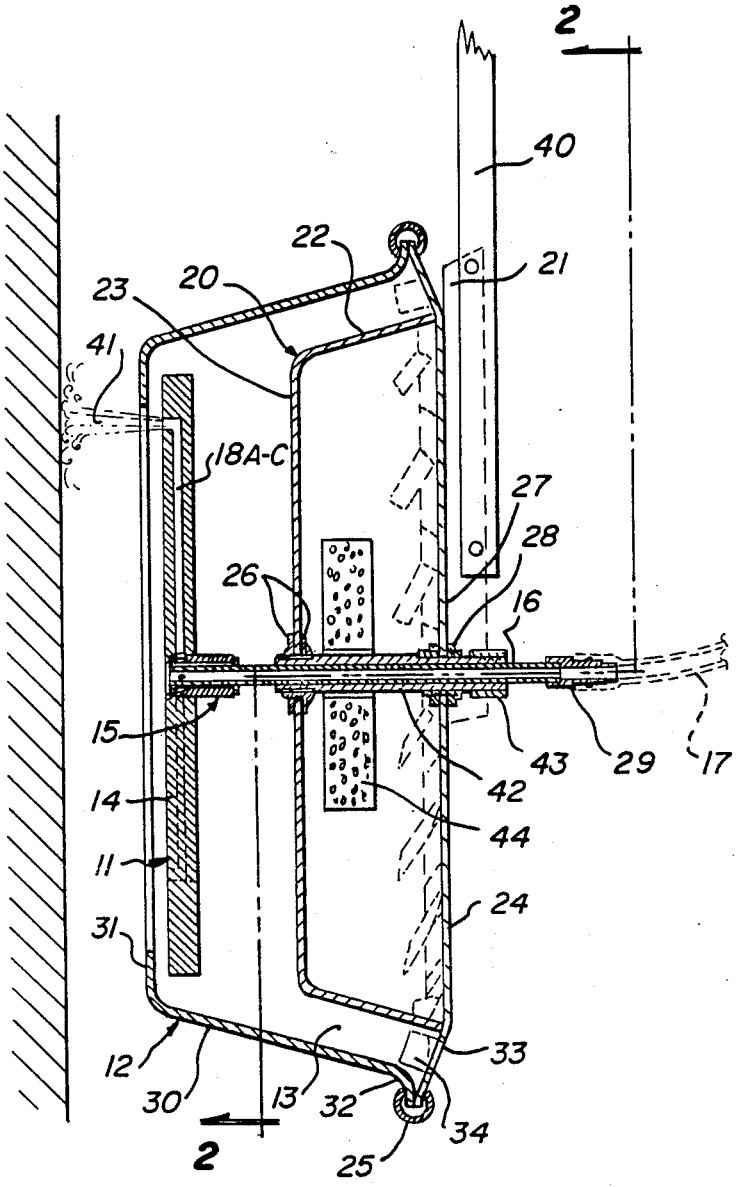
FIG. 1 is a schematic representation of the invention which is shown in an axial cross-section.
Figure 2:
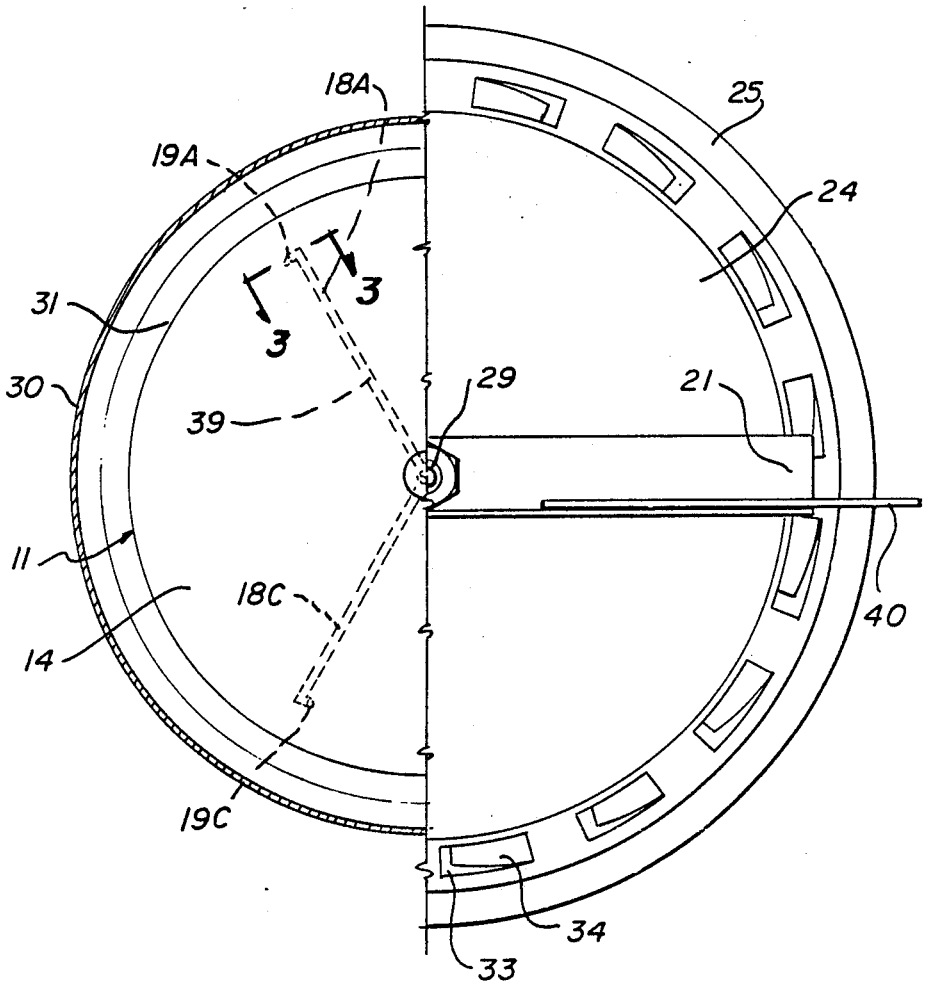
FIG. 2 shows a section along line 2—2 in FIG. 1.

The casing 12 has the main function of housing the annular chamber 13 and providing space for the nozzle holder and the supporting tube 16 with the bearing 15. The casing 12 has a main support unit 20 which is connected to an attachment rail 21 for an elongated bar 40 which acts as the support for the cleaning apparatus. The support unit 20 has an external shape like a truncated cone, where the conical surface 22 and the closed top surface 23 form the internal boundary of the annular chamber 13. The conical part of the support unit 20 is in other words shaped like a circular trough, shown upside-down in FIG. 1. A floating unit 44 of a stiff foam material is located in the cavity formed by support unit 20.

The supporting tube 16 is furnished with a quick coupling unit 29 at its outer end, this proVides an easy means of connecting and releasing the hose 17.

The support unit 20 also supports the cover unit 30 which forms the external boundary of the annular chamber 13. The cover unit 30 is another truncated conical plate with a similar form to the conical surface 22, but with a larger radius to compensate for the thickness of the annular chamber 13. At the narrow end of the cover unit 30, the edge is bent radially inwards to form a flange 31 which is located parallel and outside the end of the support unit 20. At the wider end of the cover unit 30, the edge is bent radially outwards into another flange 32.

The support unit 20 is connected to the cover unit 30 by a circular cover plate 24 which is attached by a clamp ring 25 to the cover plate 24 by welding along the edge or some other suitable means.

The supporting tube 16 is led through an attachment tube 42 which is located centrally in the support unit by two sets of nuts, 26 and 27 respectively, one set at the end plate 23 and the other at the cover plate 24. At the outer end of the attachment tube 42 there is a sealing unit 43 which loosely holds the supporting tube 16. This enables the axial position of the supporting tube 16 to be regulated in relation to the support unit 20 and the cover unit 30. This makes it possible to regulate the axial distance of the nozzle holder 11 from the surface of the object which is to be cleaned. This is an advantage which allows cleaning to be adjusted to accommodate different surfaces and various types and degrees of pollution.

The attachment rail 21 has a hole at the fixed end, this fits over the supporting tube 16 and is held under the outer nut in the outer set of nuts 27 by means of an additional nut 28.

The concentric area of the cover plate 24 which extends from the chamber between the support unit 20 and the cover unit 30 has concentrically situated chamber outlets 33 at regular intervals along the circumference.

On one side of the chamber outlet which lies in a radial plane to the cover plate 24, there are vanes 34 in the chamber between the support unit 20 and the cover unit 30. The vanes are located at a 30 degree angle to the conical edge. This means that the vanes 31 function as blades which lead the water through the chamber outlets.

If one wishes to collect or remove the residue which has been flushed loose and passed through chamber 13, the cover plate 24 can be designed with fewer outlets or a reversed manifold with a nozzle fitted to a filter bag or another hose.. These bags will enable the residue to be filtered from the water, whilst a hose can be used to lead the "flushed water" directly to a drainage outlet. Such arrangements would be ideally suited for basins such as swimming pools or containers for fish farming.

Bearing 15 is illustrated in more detail in FIG. 4. The supporting tube 16 is closed at its outer end by a flange face 45. The end of the spindle could be threaded for instance. There is a bush 35 located at the end of the flange face 45 which is held in its axial position by means of a locking screw 36. The interior of the supporting tube 16 is linked to an internal annulus 37 in the bush 35 by means of four radial holes 38. The annulus 37 also acts as a manifold for three tubes 39 (one of which is shown in FIG. 4), which form ducts 18*a–c*. Both the bush 35 and the tubes 39 are cast within disc 14.

Apart from the elements which are illustrated, the bush or bearing 15 can be fitted with washers, sleeve joints etc, as appropriate.

During use the cleaning apparatus invented here can be maneuvered by means of the bar 40 which is joined to the attachment rail 21. The bar 40 is fitted with a handle at the end. This enables the cleaning apparatus to be easily maneuvered from the edge of a water container, from a cage, from a ship or platform deck or in other cases where a vertical wall or surface is to be cleaned.

If the apparatus is to be used for cleaning horizontal or mainly horizontal surfaces, the handle bar 40 can be fitted with a device which permits the apparatus to be used in an inclined position.

If the apparatus is to be used to clean the upper side of horizontal surfaces, the attachment point on the handle nearest the supporting tube allows the apparatus to operate in a number of inclined positions. When cleaning the side of a boat the attachment point nearest the edge of the apparatus should be used. This will allow cleaning to be carried out from the deck, which reaches substantially under the boat.

The handle bar can also be extended by extra joints which should make it possible to guide the apparatus under the bottom of a boat when standing on a deck. The cleaning apparatus could also be remote controlled or guided by divers. Such configurations are more applicable for the hulls of larger ships.

FUNCTION:

When water is supplied under pressure through a hose 17 the nozzles of the outlet ducts 18*a–c* will create pressure jets 41 which leave the nozzle holder 11 at an oblique angle. The water jets 11 will produce a reaction force with tangential and axial components. The tangential component causes the nozzle holder to rotate. This rotation will in turn result in a pumping action in the water volume surrounding the disc 14, which forces the water through the annular chamber 13.

The water pressure in the chamber behind the nozzles exerts an effect in all directions. The pressure is consequently also exerted in the direction of the chamber wall. Since the pressure is exerted in all directions, this force will work against itself. However, as par of the chamber wall has been removed, there will be no effect from the water pressure here. The pressure on the other side of the chamber wall on an equivalent area is not confronted by a counter force and this causes the nozzle holder to rotate. If the nozzles had jets directed radially at right angles to the radius, a force equal to the water pressure × the area of the nozzle opening would be exerted on the nozzle holder in the direction of rotation.

The torque of the nozzle holder in the direction of rotation will be reduced when the nozzles approach a right angle to the circular line they are located on, whilst the flushing power will increase commensurately. When the nozzles are situated so that the jets are directed perpendicularly to the rotation plane, the water pressure will move the apparatus away from the direction of the jets with maximum output. In this case there will not be any torque and the nozzle holder will stand still. The apparatus will be pushed away from the object it is to clean. The nozzles must consequently be laterally adjusted with respect to the nozzle holder's radial plane so that the torque exceeds the friction with enough of a margin to overcome the increased friction caused by rotation, thus providing the nozzle holder with sufficient velocity.

As the front edge of the cover unit 30 is located against the surface to be cleaned, the rotating disc is prevented from coming into contact with the object which is to be cleaned.

The internal conical shape of the casing has the important function of keeping the apparatus close to the object. This effect comes into play when the nozzle holder rotates. Here the friction between the nozzle holder and the water will cause the movement in the water. The motion of the water is tangential along the rotating nozzle holder, whilst at the same time it rotates the nozzle holder in relation to the static casing.

The water collides with the sloping inside of the casing which produces a slight internal increase in pressure, whilst the pressure on the outside of the casing is unaffected and consequently less.

This difference in pressure and the narrow openings in the outer edge of the casing results in moving the apparatus towards the object which is to be cleaned.

The pressure is minimal compared to the pressure in the water supplied to the nozzles, however this low pressure has a large surface area to work upon. The size of the surface is determined by the difference between the largest and smallest radius of the casing.

In addition to the increase in pressure on the inside of the casing, there is a small drop in pressure in the water mass on the side of the object facing the apparatus where the water flows in between the rotating nozzle holder and the casing. This helps to increase the water pressure behind the apparatus which presses the apparatus against the object which is to be cleaned.

This occurs even when the apparatus is working on a perforated surface or net.

When the apparatus is working on an unbroken surface, the water which the nozzle holder causes to rotate is supplied between the casing and the object. This will mean that there is less pressure between the apparatus and the object then in the water mass surrounding the apparatus. This difference in pressure is found on a surface which approximately equals the surface bounded by the narrowest opening in the casing. It is this difference in pressure which holds the apparatus on to the surface with a relatively large force.

ALTERNATIVES:

In an alternative form of design the supporting tube 16 can be replaced by a spindle and the bearing 15 located on the support unit.

The number of outlet tubes or ducts can be larger or smaller than in the example described above. The same is true for the number of nozzles or outlet ducts 19*a–c*.

Apart from this there are naturally a number of details in the construction that could be designed in alternative ways than shown in the example. The casing could for instance be designed with a cylindrical basis, or conically in the reverse shape than that in the example. The latter is relevant for cleaning equipment designed for cleaning the floor of containers with vertical walls.

I claim:

1. A cleaning apparatus for use under water, particularly for cleaning vertical surfaces which have been fouled by marine organisms, where there is a set of nozzles for spraying water under high pressure against a surface which is to be cleaned and where there is a reaction means which holds the nozzle set in position against the said surface, said nozzle set includes at least one nozzle, the apparatus is characterized by the nozzle set being located on a rotating, disk-shaped holding unit where the rotation axis is generally perpendicular to the surface which is to be cleaned, said set of nozzles also producing a tangential spray component that causes rotation and around the peripheral areas of the rotating holding unit there is a casing which forms an annular chamber with an outlet means for water which is at least partly directed away from the surface to be cleaned and which forms said reaction means.

2. A cleaning apparatus in accordance with claim 1, is characterized by the casing having a cover unit and a support unit, said cover and support units are separated from each other with the nozzle holding unit positioned concentrically therebetween.

3. A cleaning apparatus in accordance with claim 2, is characterized by the cover and support units being connected along their outer edges by a cover plate which has said outlet means in the circular area between the cover and support units, and the outlet means are fitted with oblique vanes.

4. A cleaning apparatus in accordance with claim 2, is characterized by the rotating disc-shaped holding unit being located closer to the cover unit than the support unit.

5. A cleaning apparatus in accordance with claim 4, is characterized by an outer part of the cover unit having a radial inward extending edge which is adjacent to the outer edge of the rotating disc-shaped holding unit.

6. A cleaning apparatus in accordance with claim 1, is characterized by the inclusion of a tubular, centrally located support which is equipped with coupling means for connection to a high-pressure hose, and the support is linked to outlet tubes that lead to the set of nozzles.

7. A cleaning apparatus in accordance with claim 6, is characterized by the rotating disc-shaped holding unit being joined to the tubular support by means of a central fluid bearing which is linked to the set of nozzles.

8. A cleaning apparatus in accordance with claim 7, is characterized by the rotating disc-shaped holding unit having generally flat parallel planar sides.

9. A cleaning apparatus in accordance with claim 1, is characterized by having a bar-shaped handle which is attached to the support unit and which protrudes radially outwards from the apparatus.

* * * * *